US006874551B1

(12) United States Patent
Snell et al.

(10) Patent No.: US 6,874,551 B1
(45) Date of Patent: Apr. 5, 2005

(54) MECHANISM FOR DISPERSING ITEMS WITHIN A LIQUID TO BE DISPENSED

(75) Inventors: Nathan Snell, Mooresville, NC (US); Rafael M. Rodriquez, Ormond Beach, FL (US); Todd Krawczyk, Ormond Beach, FL (US); Gregory Spear, Montrose, CA (US); Michael S. Marszalec, Freeport, IL (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 10/692,943

(22) Filed: Oct. 24, 2003

(51) Int. Cl.[7] ..... B65B 1/04

(52) U.S. Cl. ..... 141/329; 141/2; 141/18; 141/9; 141/104; 222/80; 222/129.1; 206/222

(58) Field of Search ..... 141/2, 9, 18, 19, 141/329, 330, 100, 104; 222/129, 129.1, 144–145.1, 80–91; 206/222; 215/227, DIG. 8

(56) References Cited

U.S. PATENT DOCUMENTS 3,003,703 A * 10/1961 Lambton ..... 239/309
6,073,808 A * 6/2000 Klima et al. ..... 222/130
6,412,526 B2 * 7/2002 Castillo ..... 141/100

OTHER PUBLICATIONS pureSmart™ Filtered Drinking Water System, Installation Operation, Aug. 30, 2002 + www.ehydrated.com.

* cited by examiner

*Primary Examiner*—Steven O. Douglas
(74) *Attorney, Agent, or Firm*—Michael P. Mazza

(57) ABSTRACT

A liquid dispenser for periodically dispersing a predetermined quantity of an item, such as chlorine or vitamin gel, into a liquid to be dispensed such as water or coffee.

18 Claims, 2 Drawing Sheets

Fig. 4
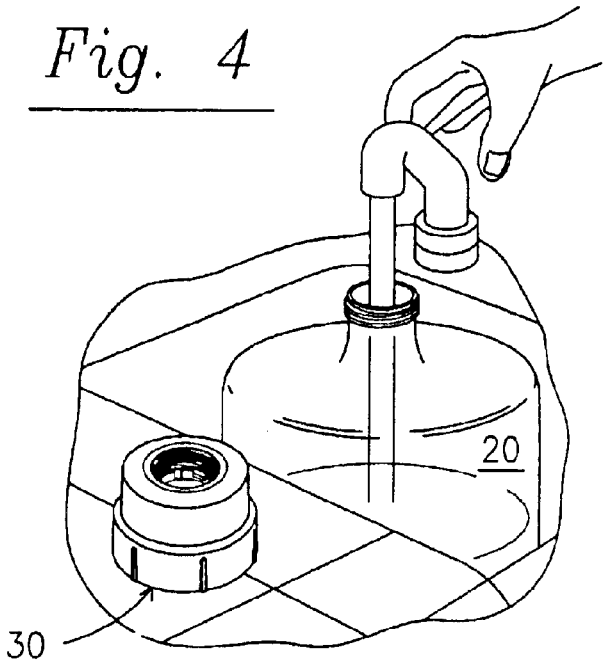
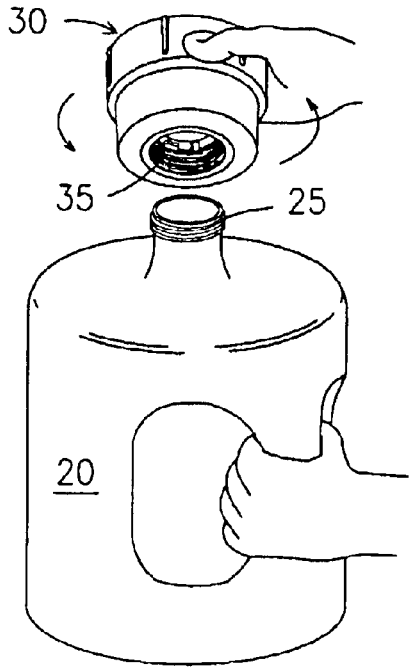
Fig. 5
Fig. 6
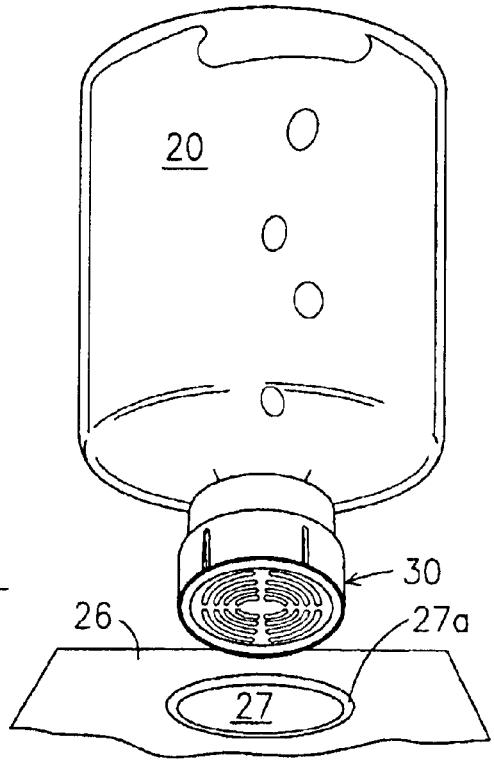

MECHANISM FOR DISPERSING ITEMS WITHIN A LIQUID TO BE DISPENSED

BACKGROUND OF THE INVENTION

The present invention generally relates to the dispersion of items within a liquid to be dispensed. In one embodiment, a self-chlorinating water dispenser is provided.

It has long been known to disperse various items into potable water supplies, such as fluorine and chlorine. Water chlorination and filtration systems have been used in the past to eliminate potentially harmful bacteria from potable water. It would be desirable to provide an efficient and economical way to disperse items into liquids such as a potable water supply for consumer use.

SUMMARY OF THE INVENTION

The objects mentioned above, as well as other objects, are solved by the present invention, which overcomes disadvantages of prior water dispensers, while providing new advantages not believed associated with such devices.

In one preferred embodiment, a device is provided for dispersing an item within a dispensable liquid, which may be but need not be contained within a container such as a bottle. The device may include a rotating, indexing mechanism carrying a piercing feature, such as a piercing nib. The indexing mechanism may but need not have a spring-loaded plunger associated with it, so that the indexing mechanism may be permitted to interfere with the device/liquid container engagement, such as threaded engagement. The device may also include a support ring positioned adjacent the indexing mechanism. The support ring may have compartments carrying discrete, predetermined portions of the item to be dispersed within the liquid, such as gel capsules. The support ring may be but need not be rigidly attached to and rotate with the rotating mechanism. The item portions may be designed to disperse a predetermined amount of the item within the liquid upon being contacted by the piercing feature. The device may be designed to engage and be in liquid communication with a liquid container for dispensing. To aid in dispersion, an absorbent pad may be positioned below the support ring.

The device may but need not include a filtration device such as a filter cartridge.

The items to be dispersed within the liquid may include gels, powders, tablets or capsules. Dispersible items may include but not be limited to chlorine, fluorine, iodine, other chemicals, vitams, food or flavoring agents, nutrients, etc. The dispensable liquid may be water, such as potable water, coffee, soft drinks, Kool-Aid, sports drinks, etc.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings. The drawings illustrate currently preferred embodiments of the present invention. As further explained below, it will be understood that other embodiments, not shown in the drawings, also fall within the spirit and scope of the invention.

FIG. 4 is a perspective view of a water bottle being filled, together with one preferred filtering and chlorinating water dispenser in accordance with the present invention;

FIG. 5 is a perspective view showing a threaded connection between a preferred water dispenser of the present invention and a water bottle; and FIG. 6 is a perspective view showing the water dispenser engaged to the water bottle, just prior to seating onto the upper housing of one water dispenser housing.

DETAILED DESCRIPTION OF THE PREFERRED EMBODIMENTS

Set forth below is a description of what are currently believed to be the preferred embodiments and/or best examples of the invention claimed. Future and present alternatives and modifications to these preferred embodiments are contemplated. Any alternatives or modifications which make insubstantial changes in function, in purpose, in structure or in result are intended to be covered by the claims of this patent.

The liquid dispenser and its dispersion apparatus of the present invention may be used with various types of liquid dispensers. In a preferred embodiment, the chlorinator may be used with the filter shutoff mechanism disclosed in co-pending U.S. Ser. No. 10/692,603, titled "WATER DISPENSER HAVING VARIABLE FILTRATION CAPACITY AND REPLACEABLE CARTRIDGE FILTER," filed on the same day as this patent application, and incorporated by reference in its entirety herein.

Figure 1:
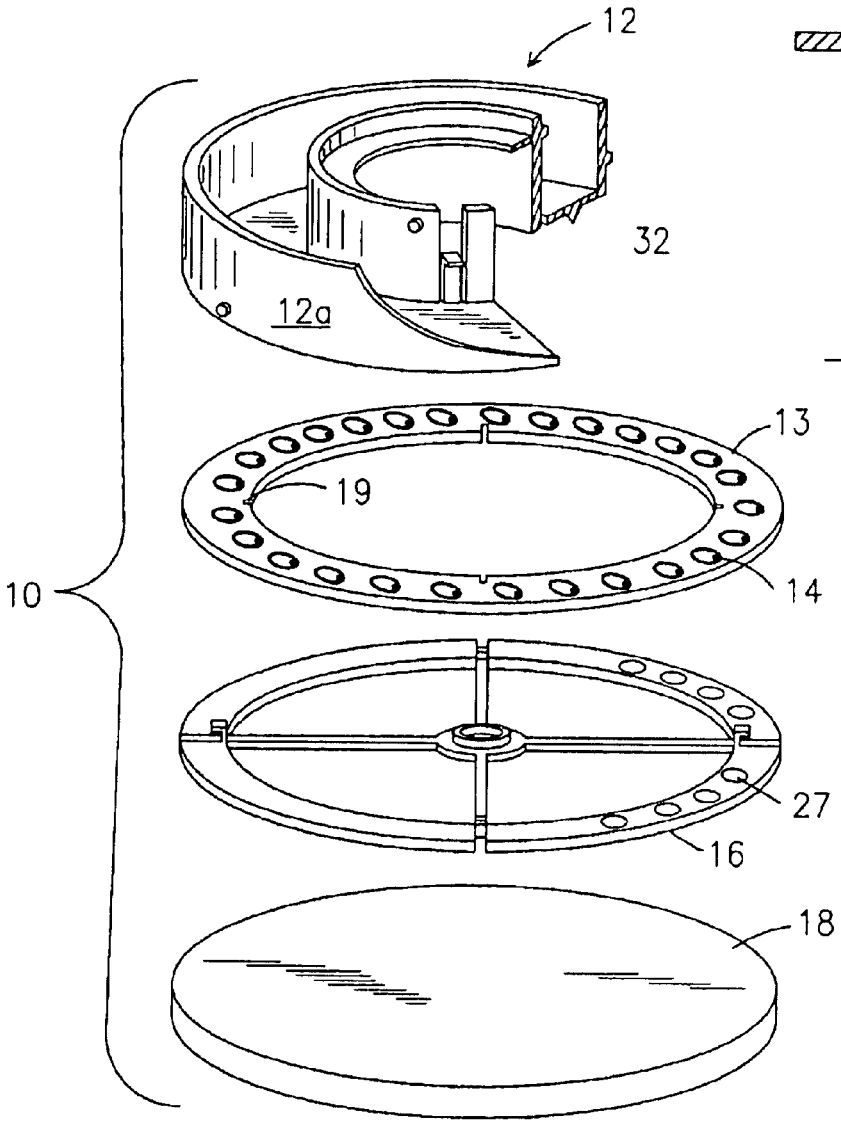
FIG. 1 is an exploded, partial sectional and partial perspective view of one preferred chlorinator dispenser embodiment of the present invention.

Referring first to FIG. 1, a preferred embodiment of the dispersion mechanism of the present invention is generally referred to by the reference numeral 10. Dispersion mechanism 10 may be incorporated within an "automatic filter shutoff mechanism" of the type disclosed in co-pending U.S. Ser. No. 10/692,603 and shown in FIGS. 4–6, and generally bearing reference numeral 30. Filter shutoff mechanism 30 is so-named because after a predetermined amount of liquid dispensing has occurred, the mechanism automatically interferes with further engagement between the bottle container and the mechanism until the filter has been replaced, as further explained in co-pending U.S. Ser. No. 10/692,603. Referring back to FIG. 1, dispersion mechanism 10 may include indexing mechanism 12, annular disc or strip 13 carrying gel tablets 14, circular retention ring 16, and absorbent pad 18.

Figure 2:
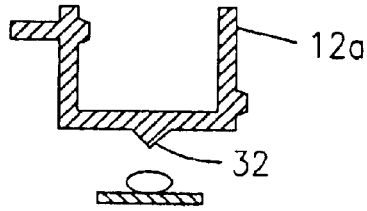
FIG. 2 is a sectional view according to the cross-hatched portion of FIG. 1.
Figure 3:
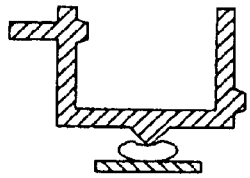
FIG. 3 is a sectional view similar to FIG. 2 showing piercing of a gel tablet.

Referring now to FIGS. 2 and 3, in a preferred embodiment indexing mechanism 12 includes outer wall 12*a* and may include a puncture feature such as nib 32.

In a preferred embodiment, a filter may be installed on a water bottle, such as a filter cartridge used with the filter shutoff mechanism and also disclosed in U.S. Ser. No. 10/692,603. Referring back to FIGS. 4–6, a water container such as water bottle 20, may be engaged to filter shutoff mechanism 30 as shown. While it is preferred that water bottle 20 have threads 35 that allow threaded connection with mating threads 25 on the neck of water bottle 20, a threaded connection is not required. Referring to FIG. 6, shutoff mechanism 30 may be sized and shaped to permit its placement within opening 27 of water cooler housing 26. (The particular water dispenser chosen for use is of little importance to the present invention.) For example, a lower portion of filter device 30 may rest on the top peripheral wall 27*a* of water cooler housing opening 27.

Referring now to FIG. 1, a spring-loaded plunger portion (not shown) associated with rotating, indexing mechanism 12 may be depressed each time the water bottle is inserted, e.g., when the bottle opening threadably engages and presses down on indexing mechanism 12. The plunger stroke causes indexing mechanism 12 to move downward, causing nib 32 to contact and pierce or puncture a "gel" tablet 14 on disc 13. This action may be caused to release a predetermined amount of the gelled item, such as chlorine, to drop onto absorbent pad 18 positioned directly below disc 13. Given appropriate gel dosing, this procedure can cause the device to maintain a predetermined level of dispersion of the item within the liquid to be dispensed or used, such as a certain chlorination level range within a known volume of bottled water or other potable water supply. As water passes through the chlorination pad for example, prior to dispensing to the consumer, harmful bacteria is killed. In this embodiment, after water passes through the chlorination pad, the water may then pass through the filtration system, providing satisfactory drinking water.

Retention ring 16 preferably supports disc 13. A tab or locator 17, as shown in FIG. 1, may be positioned on the upper portion of retention ring 16, designed to mate with a corresponding opening 19 on disc 13, to maintain disc 13 in proper location. Retention ring 16 may also have corresponding apertures located in the disc body to permit the free passage of chlorine to pad 18. Retention ring 16 may also be used to retain pad 18 in position.

Retention ring 16 may be ultrasonically welded or otherwise fixed to dispenser canister 10.

The number of gel tablets located along ring 13 may depend on the desired frequency of dispersion.

In operation of the preferred embodiment shown in the drawings, chlorination ring 13 and retention ring 16 may remain fixed in position. Indexing mechanism 12 of dispensing canister 30 may be caused to rotate incrementally as water bottles are refilled, and as further explained in co-pending U.S. Ser. No 10/692,603. Gel tablets 14 may be sized and located about ring 13 so as to maintain a predetermined amount of chlorine within chlorine pad 18, causing a predetermined amount of chlorine to be constantly and automatically applied to the water being dispensed.

It will now be understood that any items other than chlorine may be dispensed using the present invention, such as fluorine, iodine, food flavorings, antibiotics, food additives or food colorings, vitamins, etc. Also, tablet or gel dispensing may occur within liquids other than water, such as coffee, soft drinks, Kool-Aid, etc. Additionally, the "tablets" may consist of any sufficiently fluid substances, which may be liquid or gel, and viscous or runny, provided that the substance is sufficiently fluid to permit dispensing upon puncture. It may be envisioned that granular or powdery substances within a sealed compartment may also be pierced or otherwise exposed using the invention to disperse such materials into a dispensable liquid.

It will be appreciated that the present invention may be employed with successive (filled) new water bottles or other water containers. Alternatively, the invention may be used with the same water bottle, which may be filled again and again.

The above description is not intended to limit the meaning of the words used in the following claims that define the invention. Rather, it is contemplated that future modifications in structure, function or result will exist that are not substantial changes and that all such insubstantial changes are intended to be covered by the following claims.

We claim:

1. A device for dispersing an item within a dispensable liquid, comprising:

a rotating, indexing mechanism carrying a piercing feature;

a support ring positioned adjacent the indexing mechanism, the support ring having compartments carrying discrete, predetermined portions of the item to be dispersed within the liquid;

wherein the item portions are designed to disperse a predetermined amount of the item within the liquid upon being contacted by the piercing feature.

2. The device of claim 1, wherein the device is designed to engage and be in liquid communication with a liquid container for dispensing.

3. The liquid dispenser of claim 1, wherein the liquid comprises water, and the item comprises chlorine.

4. The liquid dispenser of claim 1, wherein the liquid comprises water, and the item comprises vitamins.

5. The liquid dispenser of claim 1, wherein the liquid comprises water, and the item comprises flavoring agents.

6. The liquid dispenser of claim 1, wherein the item comprises vitamins.

7. The liquid dispenser of claim 1, wherein the item is in gel form.

8. The liquid dispenser of claim 1, wherein the item comprises a viscous liquid.

9. The liquid dispenser of claim 1, further comprising an absorbent pad positioned below the support ring.

10. A self-chlorinating water dispenser having a housing and designed to engage and be in water communication with a water container, comprising:

a rotating, indexing mechanism contained within the water dispenser housing and including a plunger having a piercing feature;

a support ring carrying discrete, predetermined portions of chlorine;

wherein the chlorine portions are designed to disperse a predetermined amount of chlorine within the water upon being contacted by the piercing feature.

11. The self-chlorinating water dispenser of claim 10, further comprising an absorbent pad located below the support ring.

12. The self-chlorinating water dispenser of claim 10, wherein the support ring is rigidly attached to and rotates with the rotating mechanism.

13. The self-chlorinating water dispenser of claim 10, wherein the water container comprises a water bottle having a threaded neck.

14. The self-chlorinating water dispenser of claim 10, wherein the plunger is spring-loaded.

15. The self-chlorinating water dispenser of claim 10, wherein the piercing feature comprises a relatively sharp, downwardly extending nib.

16. The self-chlorinating water dispenser of claim 10, wherein the chlorine portion comprises a gel capsule.

17. The self-chlorinating water dispenser of claim 10, wherein the water dispenser also comprises a filtration device.

18. The self-chlorinating water dispenser of claim 10, wherein the piercing feature comprises a nib.

* * * * *